US008453306B2

(12) United States Patent
Mazza et al.

(10) Patent No.: US 8,453,306 B2
(45) Date of Patent: Jun. 4, 2013

(54) METHOD FOR UPHOLSTERING BOX SPRINGS

(75) Inventors: Mark Mazza, Greensboro, NC (US); Bernard Simon, Whitsett, NC (US); Steve Wall, Browns Summit, NC (US); Janet Walker, Jamestown, NC (US); Roger Tornero, Greensboro, NC (US)

(73) Assignee: L & P Property Management Company, South Gate, CA (US)

( * ) Notice: Subject to any disclaimer, the term of this patent is extended or adjusted under 35 U.S.C. 154(b) by 1142 days.

(21) Appl. No.: 12/174,092

(22) Filed: Jul. 16, 2008

(65) Prior Publication Data

US 2010/0011553 A1 Jan. 21, 2010

(51) Int. Cl.
*B68G 15/00* (2006.01)
*B68G 7/05* (2006.01)

(52) U.S. Cl.
CPC .. *B68G 15/00* (2013.01); *B68G 7/05* (2013.01)
USPC ..... 29/91.1; 29/91.5; 29/91.7; 5/402

(58) Field of Classification Search
USPC ..... 29/91, 91.1, 91.5, 91.6, 91.7, 91.8; 5/400, 5/402, 737, 738
See application file for complete search history.

(56) References Cited

U.S. PATENT DOCUMENTS 726,311 A * 4/1903 Klem ..... 112/436
1,544,141 A * 6/1925 Eddins ..... 297/228.11
2,108,242 A * 2/1938 Wallace ..... 5/402
2,151,628 A * 3/1939 Van Derveer ..... 5/402
2,159,535 A * 5/1939 Schulman ..... 5/717
2,161,448 A * 6/1939 Bishop ..... 297/228.11
2,172,224 A * 9/1939 Sailer ..... 112/410
2,212,485 A * 8/1940 Krasnov ..... 297/224
2,483,223 A * 9/1949 Moss ..... 297/228.11
2,551,044 A * 5/1951 Ottinger et al. ..... 383/76
3,338,630 A * 8/1967 Dudley ..... 297/228.11
3,807,200 A * 4/1974 Liwski ..... 66/170
3,887,968 A * 6/1975 Lynam ..... 24/712
3,911,603 A * 10/1975 Lehrman ..... 38/140
4,477,928 A * 10/1984 Graff ..... 2/221
4,732,097 A * 3/1988 Guilhem ..... 112/475.26
RE33,586 E * 5/1991 Graff ..... 2/221
5,040,244 A * 8/1991 Tubbs ..... 2/237
5,150,947 A * 9/1992 Croshaw ..... 297/229
5,375,266 A * 12/1994 Crisco ..... 2/243.1
5,400,729 A * 3/1995 Bryant ..... 112/470.31

(Continued)

*Primary Examiner* — David Bryant
*Assistant Examiner* — Jason L Vaughan
(74) *Attorney, Agent, or Firm* — Shook Hardy & Bacon LLP

(57) ABSTRACT

The present invention generally relates to an apparatus and a method used to upholster a box-spring frame. A textile tape with a portion encapsulating a draw cord is sewn to the inner perimeter of a border material. The other edge of the border material is sewn to a top cover material. The box-spring frame is placed within this assembly, with the top side of the frame abutting the top cover. This assembly is placed in the attachment apparatus. The attachment apparatus optionally compresses the box-spring frame and is equipped with a pair of tension applicators. Once in place, each of the two draw cord ends are secured to a corresponding tension applicator, and tension is applied to the draw cord. This tension tightens the border assembly edge around the frame. With the proper tension applied, the draw cord is secured to the box-spring frame. The bottom cover is then attached in the conventional manner with a series of staples.

4 Claims, 3 Drawing Sheets

U.S. PATENT DOCUMENTS 5,452,591 A * 9/1995 King ..... 66/83
5,457,854 A * 10/1995 Easom ..... 24/300
5,529,373 A * 6/1996 Olson et al. ..... 297/218.4
5,758,519 A * 6/1998 Joyce et al. ..... 66/83
5,768,758 A * 6/1998 Deignan et al. ..... 29/91.1
5,935,364 A * 8/1999 Groendal et al. ..... 156/216
5,950,553 A * 9/1999 Bohlinger et al. ..... 112/475.08
6,286,341 B2 * 9/2001 Jackson et al. ..... 66/83

* cited by examiner

METHOD FOR UPHOLSTERING BOX SPRINGS

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention relates to upholstering bedding products and more specifically to the upholstery of a box spring unit.

BACKGROUND OF THE INVENTION

The bedding currently used by a number of people includes both a mattress and a box-spring. A box-spring is a typically made from wooden frame, covered in cloth, and often contains a set of firm springs. Usually the box-spring is placed on top of a wooden or metal bed frame which sits on the floor and acts as a brace. The box-spring is usually the same size as the mattress, which rests on the box-spring. Working together, the frame, box-spring, and mattress make up a bed.

Currently more and more box-springs are being made out of wood, then covered in fabrics. The wooden frame of the box-spring is covered with a top cover, a border material generally around the side or perimeter of the box-spring, and a bottom cover. These covering materials present an attractive appearance, and provide a protective barrier from the internal construction of the box-spring. In current practice, the border material is sewn to the top cover fabric. The box-spring is then positioned on the top-cover and the border material is pulled by hand around the side of the box-spring and stapled to the bottom of the box-spring frame. After the top-cover and border material are attached, the bottom cover is attached. The bottom cover is typically a light textile material and is stapled in place.

The process of pulling the cover and border assembly and then stapling the assembly to the frame of the box-spring is disadvantageous for a number of reasons. The manual nature of the process requires a person to perform work on the entire perimeter of the box-spring. So, the operator must walk around the perimeter, grasp the border material, apply tension by pulling, and then staple the border material in place. The manual nature of the process also requires the supply of an additional amount of border material. This additional amount is needed to provide the operator something to grab and hold so tension can be applied.

BRIEF SUMMARY OF THE INVENTION

The present invention generally relates to an apparatus and a method used to upholster a box-spring frame. A textile tape with a portion encapsulating a draw cord is sewn to the inner perimeter of a border material. The other edge of the border material is sewn to a top cover material. The box-spring frame is placed within this assembly, with the top side of the frame abutting the top cover. This assembly is placed in the attachment apparatus. The attachment apparatus optionally compresses the box-spring frame and is equipped with a pair of tension applicators. Once in place, each of the two draw cord ends are secured to a corresponding tension applicator, and tension is applied to the draw cord. This tension tightens the border assembly edge around the frame. With the proper tension applied, the draw cord is secured to the box-spring frame. The bottom cover is then attached in the conventional manner with a series of staples.

Additional objects, advantages, and novel features of the invention will be set forth in part in the description which follows, and in part will become apparent to those skilled in the art upon examination of the following, or may be learned by practice of the invention.

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWING

The present invention is described in detail below with reference to the attached drawing figures, wherein.

DETAILED DESCRIPTION OF THE INVENTION

Figure 2:
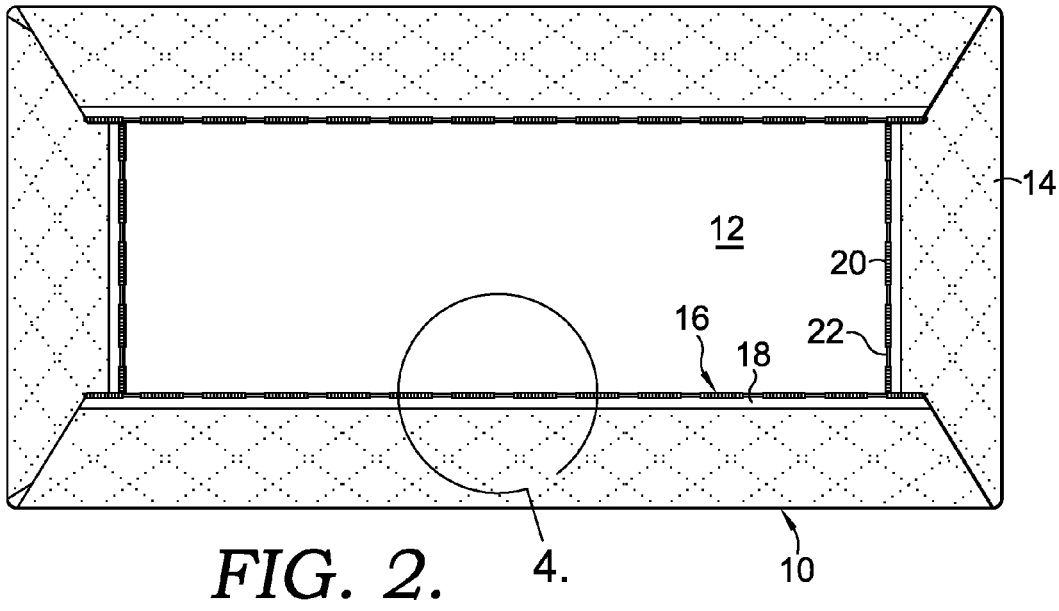
FIG. 2 is a top view of a top cover, border assembly and edge-tape material assembly prior to attachment to a box spring frame.
Figure 4:
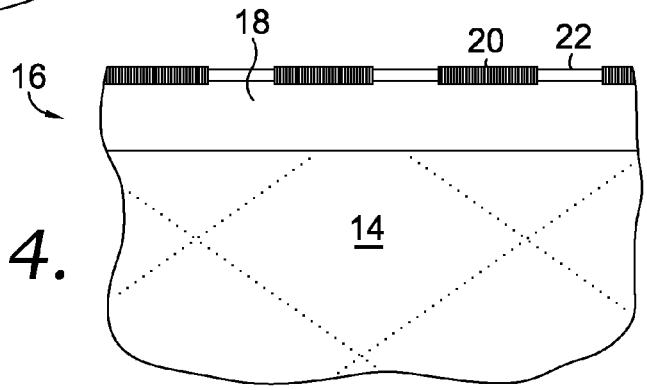
FIG. 4 is an enlarged area of the encircled region of FIG. 2.

Referring initially to FIG. 2, a covering assembly 10 for covering the top and sides of a box-spring frame is shown. The assembly 10 has a top panel 12 sewn to a border material 14, as is known to those of skill in the art. As viewed in FIG. 2, a tape material 16 is coupled to the inner perimeter of the border material 14. As best seen in FIG. 4, the tape material 16 has a tape body 18 and an integral tunnel 20 formed therein. A cord 22 is disposed through the tunnel 20 and is allowed to slide laterally within the tunnel 20. In a preferred embodiment, the tape material 16 is sewn to the border material 14 with an automatic serger machine. The tape material 16 is preferably formed from a narrow loom warp knit. While knitting is the current preferred embodiment, it should also be understood that other processes for forming the tape material could be used, such as, for example, weaving. The body 18 of the tape 16 is preferably made from a polyester yarn, 2/150 denier and can be made any desirable width. It has been found that a width of approximately 20 millimeters is adequate for the desired purpose. The tunnel 20 is formed of a size to allow the cord 22 sufficient clearance allowing it to move within the tunnel. A tunnel of approximately three to four millimeters has been found acceptable. The preferred cord is a braided high tenacity polypropylene yarn, 1260 denier, with a minimum of 14 picks per inch. An acceptable and preferred tape material 16, including the cord 22, is the Cinch-Loc™ product available from the Matrex® company of Greensboro, N.C. While the preferred embodiment for the tape material 16 is described, it should also be understood that a variety of other materials and constructions could be used for tape 16, so long as the tape is attached to the border material and includes a contained cord, movable within the tape.

Figure 1:
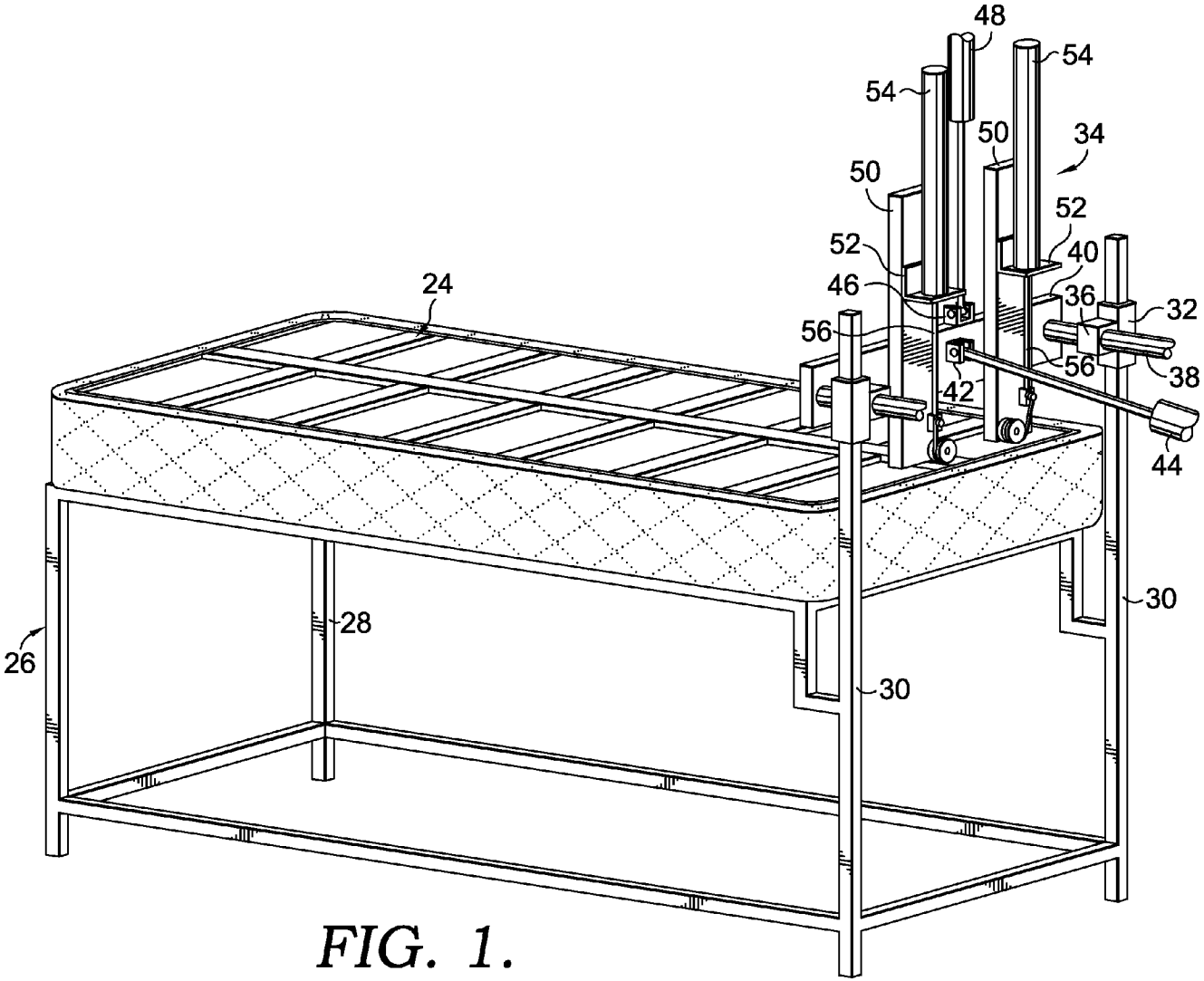
FIG. 1 is a perspective view of an exemplary apparatus for practicing the invention, shown with a box-spring in place.

As best seen in FIG. 1, the cover assembly 10 is positioned around a box-spring frame 24 and placed on a finishing table 26 with the bottom side facing up. Preferably, the border material 14 and tape 16 are positioned about the box-spring frame so that the ends are located approximately in the middle of a narrow end (either the foot end or head end of the box-spring) of the box-spring frame. The finishing table 26 has a supporting frame 28 made from a sturdy material, such as square steel tubing. The frame 28 includes two vertical end supports 30 that extend vertically above the top-most surface of the box-spring frame 24. The supports 30 have a pair of slides 32 that guide vertical movement of a tension assembly 34 along the supports 30. The slides 32 may be equipped with an inner bearing surface to facilitate the vertical movement.

A bearing block 36 is coupled to each slide 32, such as by welding. The bearing blocks provide sliding support for a shaft 38, shown truncated in FIG. 1. It should be understood that the shaft 38 is supported by a frame (not shown), which also supports other components of the tension assembly as further described below. Each shaft 38 extends through the corresponding bearing block 36 and is attached to a horizontal plate 40. Plate 40 can be made of any suitable material to support the remainder of the tension assembly 34, such as a steel or aluminum plate. A mounting bracket 42 is attached to a central portion of the plate 40. The bracket 42 is used to attach the rod of an adjusting cylinder 44. Cylinder 44 is attached to the supporting frame and is used to position the tension assembly inwardly and outwardly with respect to the box spring frame 24. Another mounting bracket 46 is attached to the top surface of the plate 40. Mounting bracket 46 is used to attach the rod of a cylinder 48, also coupled to the supporting frame. The cylinder 48 is used to position the tension assembly 34 upwardly and downwardly with respect to the box spring frame 24, guided by the slides 32 and vertical supports 30.

Figure 3:
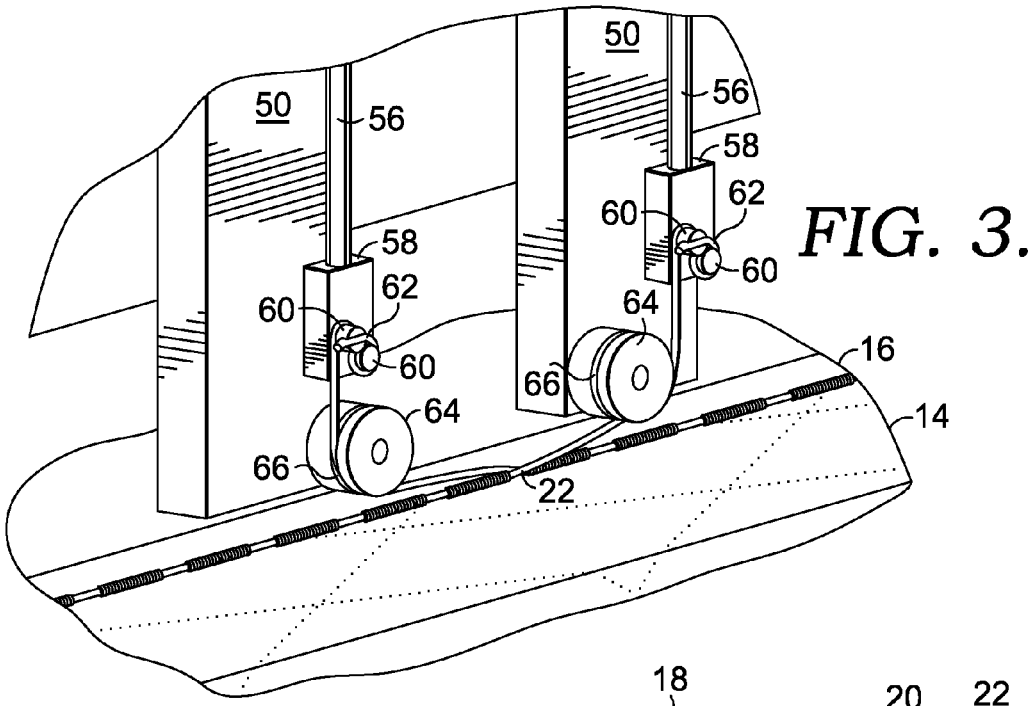
FIG. 3 is and enlarged view of a portion of the apparatus shown in FIG. 1.

The horizontal plate 40 supports a pair of mounting members 50. Each member 50 is shown as a rectangular plate and can be made of any suitable supporting material such as steel or aluminum. Each member 50 is rigidly coupled to the plate 40, such as, for example, by welding. An L-shaped cylinder bracket 52 is secured to each member 50 and supports a corresponding biasing member or cylinder 54. The cylinders can be, for example, pneumatic cylinders. Other mechanisms could be used to apply tension to the cord, as explained in the method below. Each cylinder 54 has an extending rod 56 terminating in a mounting block 58. Each mounting block 58 has a pair of cylindrical anchors 60 extending therefrom. As best seen in FIG. 3, one of the anchors 60 on each block 58 has a slot 62 formed therein, the purpose of which is explained below. When engaged, the cylinders 54 will retract the rods 56, pulling the blocks 58 upwardly. A pulley 64 is coupled to the lower portion of each mounting member 50. Each pulley has a groove shaped to accommodate the cord 22.

Having generally described the apparatus, the method of its use will now be described. In the currently preferred embodiment, the tape material 16 is supplied in rolls or festooned and is attached to the border material 14 with an automatic serging machine. This assembly of border material and tape can then be inventoried and cut to a desired length to fit the size of the box-spring frame. The side of the border material 14 opposite the tape material 16 is sewn to the top 12. This forms a "bucket" like structure into which the box-spring frame 24 is placed. The box-spring frame 24 with the covering material in place is located on the finishing table 26. Once in place on the table, the tension assembly is located vertically so that the pulleys 64 are just above the box-spring frame. The vertical height can be adjusted using cylinder 48.

The tension assembly 34 can also be adjusted inwardly using cylinder 44 to align the pulleys 64 with the cord 22. The cord 22 is then pulled and located within the groove 66 of the adjacent pulley, and the cut ends of the cord 22 are wrapped around the corresponding anchors 60 and secured in place in slot 62. This results in the arrangement as best shown in FIG. 3. Once secured, the cylinders 54 are engaged to apply tension to the cord 22. As the cylinders are engaged, the blocks 58 are pulled upwardly, and the cord is guided by the grooves in the pulleys so that a horizontal pulling force is exerted on the cord. The cord is pulled through the tunnel 20 in the tape material 16. As the cord is tensioned, the inner perimeter formed by the tape decreases, thereby tensioning the top 12 and border material 14 to a snug fit about the box-spring frame 24. It has been found that application of 60 to 80 psi is adequate to provide a good fit. With the tension applied, the cord 22 is secured in place to the box-spring frame 24, such as, for example, by stapling. Alternatively, the two ends of the cord can be secured together, eliminating the need to attach the ends of the cord to the box-spring frame. For example, the two ends of the cord could be secured together with a clamping device such as a metal clip crimped in place about the two ends of the cord. With the border material 14 and top 12 attached to the box-spring frame, a bottom covering material can be attached, as is known to those of skill in the art.

Figure 5:
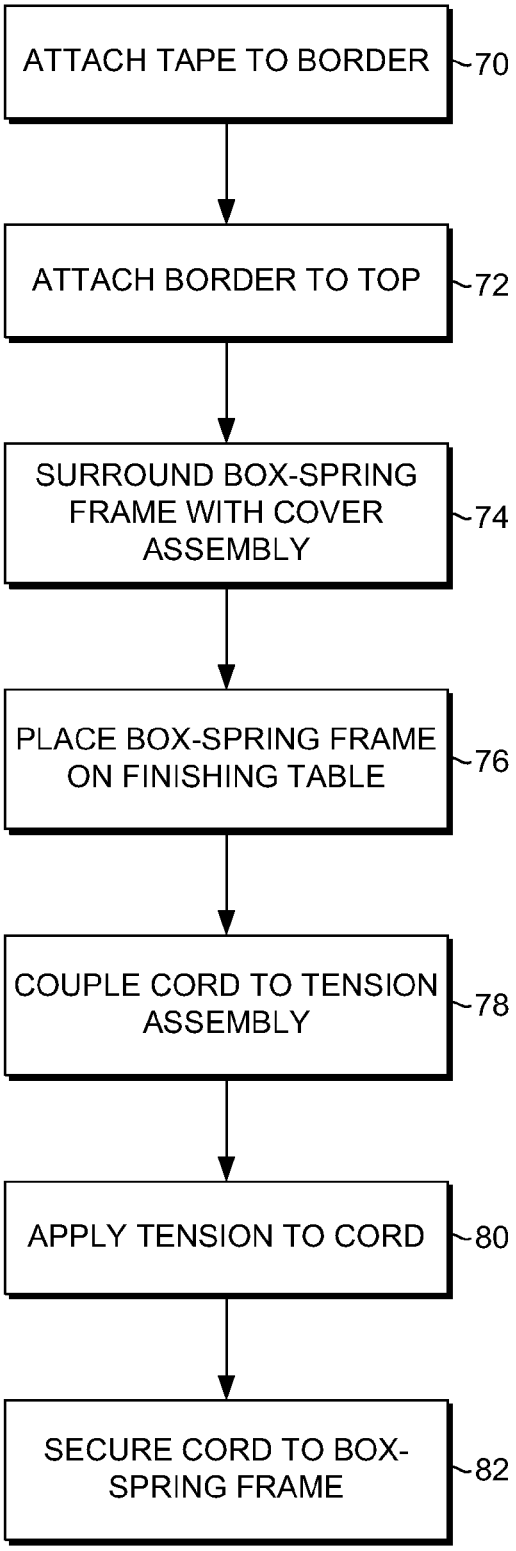
FIG. 5 is a block diagram illustrating the basic steps of a method of one embodiment of the present invention.

For the sake of completeness, the basic steps of the preceding paragraph are shown in FIG. 5. As shown in FIG. 5, to begin the process, the tape is attached to the border material in step 70 and the border material is attached to the top cover in step 72. It should be understood that these steps are not necessarily performed in this order, but that this is the current preferred embodiment. In step 74, the box-spring frame is placed within the fabric assembly. The box-spring frame and the surrounding fabric is placed on the finishing table in step 76. The operator then couples the ends of the cord to the tension assembly in step 78. The cylinders are then used to apply tension to the cord in step 80, and the cord is secured to the box-spring frame in step 82.

Although not described above, it should be understood that existing compression units can be used with the present invention. In use, these compression units act to compress the spring of the box-spring frame. With the frame compressed, the process described above for tensioning and attaching the cord 22 is performed. The compression can then be released, providing further tension to the covering material about the box-spring frame. If the compression unit is used, the framework for the tension assembly described above can be mounted directly to the compression unit, and the need for the adjusting cylinders 44 and 48 may be eliminated.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A method for attaching a border material and a top cover assembly to a box-spring frame, the method comprising:

positioning the border material and top cover assembly around a box-spring frame, which is horizontally arranged with a top side of the box-spring frame facing downward and a bottom-side of the box-spring frame facing upward, wherein the border material includes a tape material attached to an edge of the border material opposite the top cover assembly and the tape material includes a cord slidable relative to the tape material, the cord having a pair of free ends;

coupling each of the free ends of the cord to a tension assembly including a cylinder that moves upward and downward above the box-spring frame;

moving the cylinder upward, relative to the box-spring frame, to apply tension to the cord by pulling the free ends of the cord using the tension assembly; and securing the cord to the box-spring frame to retain the tension thereon.

2. The method of claim 1, wherein the cord is a braided polypropylene yarn.

3. The method of claim 1, wherein the tape material is a knit.

4. A method for attaching a border material and a top cover assembly to a box-spring frame, the method comprising:

positioning the border material and top cover assembly around a box-spring frame, which is horizontally arranged with a top side of the box-spring frame facing downward and a bottom side of the box-spring frame facing upward; wherein the border material includes a tape material attached to an edge of the border material opposite the top cover assembly and the tape material includes a cord slidable relative to the tape material, the cord having a pair of free ends;

arranging the box-spring frame underneath a tensioning assembly; aligning pulleys of the tensioning assembly above the pair of free ends; wrapping each of the free ends around a respective pulley and coupling each of the free ends to a rod of a cylinder that moves upward and downward above the box-spring frame;

moving the cylinder upward, relative to the box-spring frame, to apply tension to the cord by pulling the free ends of the cord; and securing the cord to the box-spring frame to retain the tension thereon.

* * * * *